US005246223A

United States Patent [19]

Ricciardi et al.

[11] Patent Number: 5,246,223

[45] Date of Patent: Sep. 21, 1993

[54] AUTOMATIC MAGAZINE SPEED CONTROL FOR DOCUMENT PROCESSING SYSTEM

[75] Inventors: Mario Ricciardi, Glenview; David Q. Pham, Chicago, both of Ill.

[73] Assignee: Bell & Howell Company, Skokie, Ill.

[21] Appl. No.: 816,824

[22] Filed: Jan. 3, 1992

[51] Int. Cl.[5] ..... B65H 1/02; B65H 1/16

[52] U.S. Cl. ..... 271/149; 271/31; 271/31.1; 271/155

[58] Field of Search ..... 271/31, 31.1, 149, 150, 271/152–156

[56] References Cited

U.S. PATENT DOCUMENTS

| | | | |
|---|---|---|---|
| 3,149,833 | 9/1964 | Rolon | 271/31 X |
| 3,160,293 | 12/1964 | Hennequin . | |
| 3,445,107 | 5/1969 | Stoothoff . | |
| 3,682,473 | 8/1972 | Kuyt . | |
| 3,749,395 | 7/1973 | Bazzarone et al. | 271/153 X |
| 3,894,732 | 7/1975 | Muller | 271/153 X |
| 4,509,739 | 4/1985 | Kurokawa . | |
| 4,523,753 | 6/1985 | Hiromori et al. | 271/149 X |
| 4,595,188 | 6/1986 | Wiley et al. | 271/153 X |
| 4,955,596 | 9/1990 | Ricciardi . | |

FOREIGN PATENT DOCUMENTS

| | | | |
|---|---|---|---|
| 42434 | 3/1982 | Japan | 271/153 |
| 59-102731 | 6/1984 | Japan . | |
| 92131 | 4/1989 | Japan | 271/152 |

OTHER PUBLICATIONS

Diel et al., "Horizontal Timing Belt Driven Feed Hopper", Jul., 1970, IBM Tech. Disc. Bull., vol. 13, No. 2, p. 438.

*Primary Examiner*—D. Glenn Dayoan
*Assistant Examiner*—Boris Milef
*Attorney, Agent, or Firm*—Millen, White, Zelano & Branigan

[57] ABSTRACT

A document processing system includes a feed magazine for supporting a stack of flat documents in generally upstanding on-edge relation and advancing the documents along a feed path with the documents disposed generally transverse to the feed path, a feeder assembly including feeder belts defining at least one belt run for engaging the leading document in the stack and feeding the leading document in a direction generally transverse to the feed path, and a document sensing and control apparatus for sensing the pressure exerted by documents against the sensing control apparatus and the document feed magazine, and controlling the speed of the advance of documents on the feed magazine as a function of the pressure. The greater the pressure exerted by the documents, the slower the feed magazine will advance documents to the feeder. Conversely, upon the sensation of reduced pressure against the feeder, the document sensing and control apparatus will increase the speed of the feed magazine to maintain an adequate supply of documents for efficient processing.

18 Claims, 3 Drawing Sheets

AUTOMATIC MAGAZINE SPEED CONTROL FOR DOCUMENT PROCESSING SYSTEM

BACKGROUND OF THE INVENTION

The present invention relates generally to document processing or handling systems having a document feed magazine on which a stack of documents are supported in upstanding on-edge relation, and a document feeder assembly which finds particular application in feeding relatively thick heavy flat documents advanced from the feed magazine, and more particularly to an automatic magazine speed control for such a system which controls the speed at which documents are advanced to the feeder assembly.

Document handling or processing systems are known which include a document feed magazine on which documents, such as standard size mailing envelopes or larger size flats, are stacked in upstanding on-edge relation. The stacked documents are fed in sequential fashion to a feeder assembly operative to feed successive documents to an adjacent singulating station or the like from which the documents are fed one-at-a-time to a downstream processing station, such as a reader station having an optical character reader or bar code reader operative to read sort indicia on each document, such as an address or bar code, which determines a subsequent operation or sorting sequence. Other functions may be performed on the documents downstream from the singulating and reader stations. See, for example U.S. Pat. No. 4,955,956 which is incorporated herein by reference.

It is common in such document processing systems, such as post office sorting or commercial mass mailing establishments, for an operator to place stacks of aligned documents upon the feed magazine, which then advances the documents toward the feeder assembly. It is also common for gaps of varying length to exist on the feed magazine between documents and/or stacks of documents, these gaps resulting from interruptions in the operator's routine, operator fatigue, supply to the operator, and/or other variables. Since the feed magazine operates at a constant speed, there is a time delay, the length of which depending on the size of the gap, during which the feeder assembly is starved for documents.

In view of the fact that such document processing or sorting systems are designed with optimum rates of efficiency which are often critical to the commercial success of the system, the reduction of the number and length of such gaps in the feed magazine is a significant factor in the overall efficiency of the system.

Accordingly, it is an object of the present invention to provide an automatic speed control for a document processing system which minimizes or eliminates document gaps in the feed magazine.

It is another object of the present invention to provide an automatic speed control for a document processing system wherein the speed of the feed magazine is a factor of the number and concentration of documents being fed to the document feed assembly.

It is still another object of the present invention to provide an automatic speed control for a document processing system wherein upon the sensing of document gaps at the document feeder, the speed at which documents are advanced along the feed magazine is increased.

It is yet another object of the present invention to provide an automatic speed control for a document processing system wherein upon the sensing of a significant pressure exerted by a number of documents upon the feeder assembly, the advancement of documents by the feed magazine may be interrupted.

SUMMARY OF THE INVENTION

In carrying out the present invention, a document processing assembly is provided in which the rate of advancement of a stack of documents on a feed magazine toward a feeder assembly is controlled by the pressure which those documents exert on a pivotable feed assembly. The greater the pressure exerted by the documents, the slower the feed magazine will advance documents to the feeder. Conversely, upon the sensation of reduced pressure against the feeder, the document sensing and control apparatus will increase the speed of the feed magazine to maintain an adequate supply of documents for efficient processing.

More specifically, the present document processing system includes a feed magazine for supporting a stack of flat documents in generally upstanding on-edge relation and advancing the documents along a feed path with the documents disposed generally transverse to the feed path, a feeder assembly including feeder belts defining at least one belt run for engaging the leading document in the stack and feeding the leading document in a direction generally transverse to the feed path, and a document sensing and control apparatus for sensing the pressure exerted by documents against the feed magazine and controlling the speed of the advance of documents of the feed magazine as a function of the pressure.

Preferably, the present document sensing and control apparatus includes a document sensing lever associated with the feeder to be pivotally displaced as the advanced documents exert greater pressure against the feeder. The sensing lever is connected to a potentiometer, so that the amount of pivotal displacement of the lever determines the amount of voltage sent to the drive motor for the feed magazine. The greater the amount of pivotal displacement, i.e., the greater the pressure exerted by the documents against the feeder assembly, the slower will documents be fed by the magazine. A lack of pressure exerted against the feeder assembly will cause little if any pivotal displacement of the document sensing lever, and will increase the speed of documents advanced by the magazine to maintain efficient rates of document processing.

As an illustrative example, if two thick documents approach the feed belts one after the other, the first document will be removed from the stack by the feeder. A gap then exists where the first document was. The present invention senses that gap and speeds up the feed magazine to drive the next document to the feed belts at a more rapid rate, thereby increasing the efficiency of the apparatus.

DESCRIPTION OF THE PREFERRED EMBODIMENT

Figure 1:
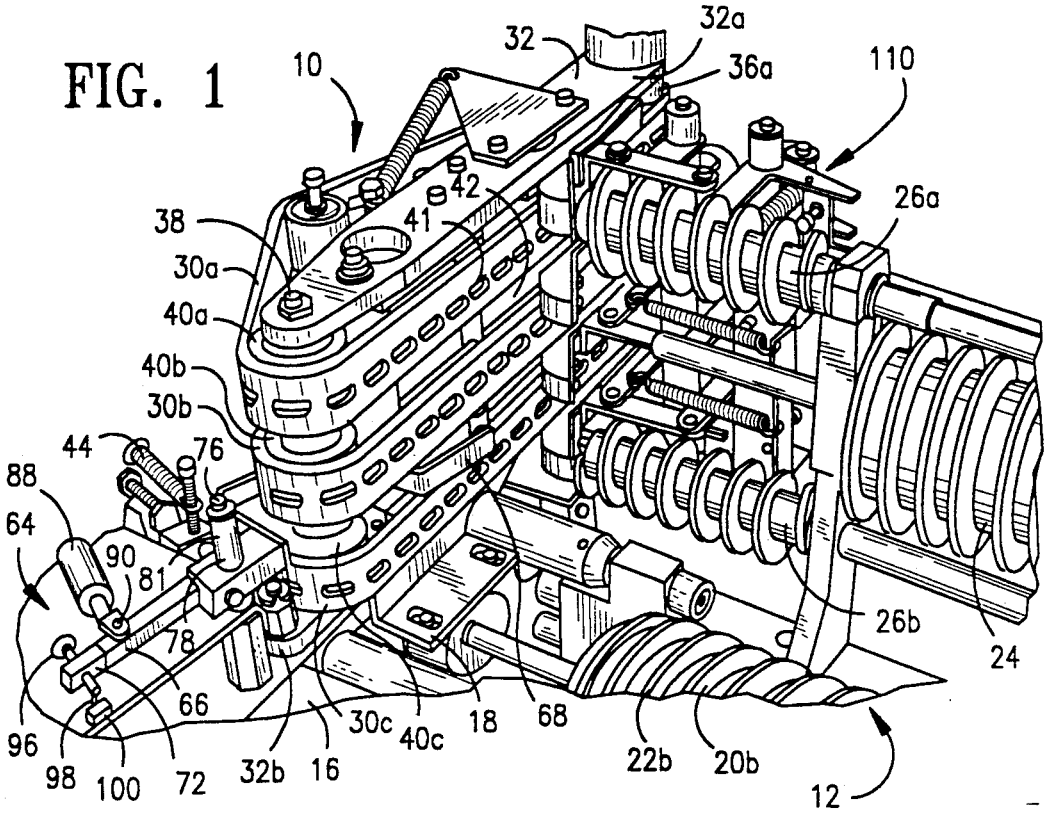
FIG. 1 is a fragmentary perspective view illustrating a document feeder assembly in accordance with the present invention in operative association with a feed magazine.
Figure 2:
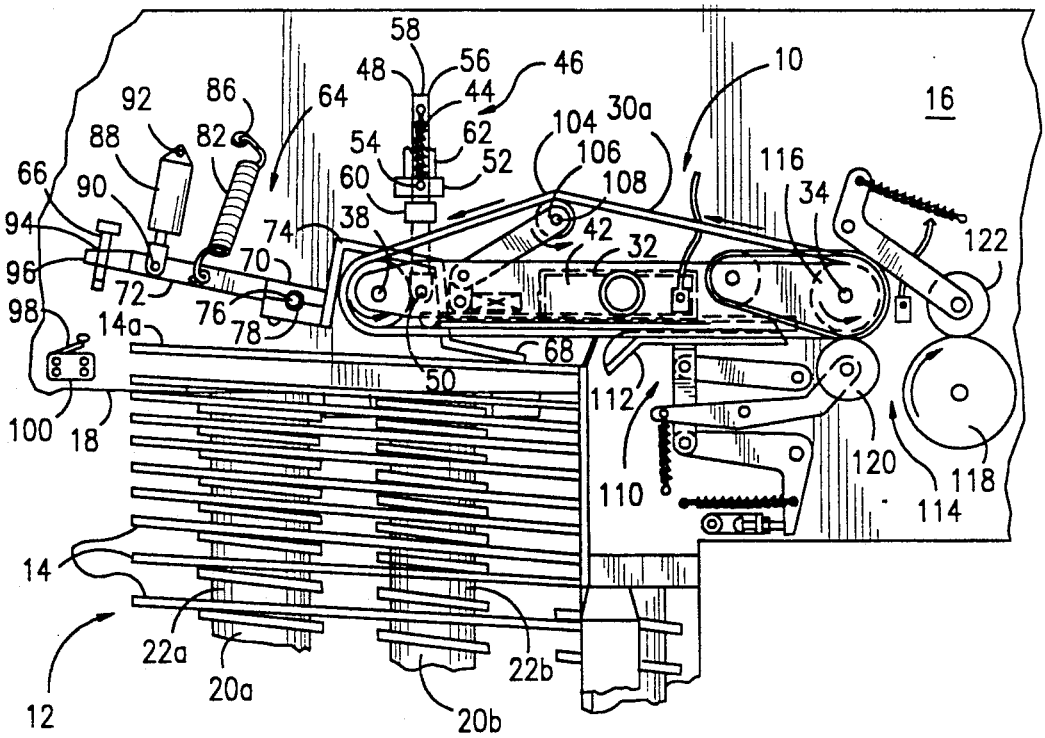
FIG. 2 is a plan view of the document feeder assembly and feed magazine illustrated in FIG. 1.

Referring now to the drawings, and in particular to FIGS. 1 and 2, a document feeder assembly constructed in accordance with the present invention is indicated generally at 10. The document feeder assembly 10 is illustrated in conjunction with a document feed magazine, indicated generally 12. The feed magazine 12 is operative to support a stack of upstanding on-edge documents, such as mailing envelopes indicated at 14 in FIG. 2, and to feed the documents in progressive fashion to the document feeder assembly 10. The feeder assembly 10 in turn feeds the documents 14 generally transversely of the feed magazine in singulated fashion to the next downstream document processing station, such as a reader station (not shown) having an optical character reader or bar code reader or the like operative to read indicia on each document, such as an alphanumeric address or bar code, which determines a subsequent operation or sorting sequence for the associated document. Other functions may be performed on the documents downstream from the feeder assembly and reader stations such as disclosed in the aforementioned U.S. Pat. No. 4,955,956 which is incorporated herein by reference.

The document feeder assembly 10 and associated feed magazine 12 are particularly adapted for feeding relatively thick heavy documents, such as documents generally termed "flats" having a rectangular size of between approximately $7\frac{1}{2}\times10\frac{1}{2}$ to $11\frac{1}{2}\times14\frac{1}{2}$ inches and a thickness of approximately 0.040 inch to $\frac{3}{8}$ inch or greater. These documents are generally relatively stiff and present problems in feeding them from a feed magazine, which problems are different than feeding conventional relatively flexible mailing envelopes or thin flats.

The feed magazine 12 includes a generally horizontal base or support plate 16 having a rectangular opening 18. A pair of identical feed augers 20*a* and 20*b* of known design are supported in parallel relation within the opening 18 such that their helically grooved peripheral surfaces extend partially above the plane of support plate 16 with the corresponding groove base surfaces 22*a* and 22*b* substantially coplanar with the upper surface of support plate 16. A third feed auger 24 is supported parallel to and spaced above the plane of the feed augers 20*a,b*. The feed auger 24 has a helically grooved peripheral surface of substantially equal pitch to the feed augers 20*a,b*.

If desired, a pair of upper and lower fourth and fifth feed augers 26*a*, 26*b* (shown in FIG. 1 only) may be located between the feed auger 24 and the feeder assembly 10. Augers 26*a,b* have a wider pitch than augers 20*a*, 20*b* and 24, and prevent bunching and sticking of adjacent documents just prior to their being fed to the feeder assembly 10.

The exposed helical grooves of the feed augers 20*a,b*, 24 and 26 respectively receive the lower horizontal edge and leading or right-hand vertical edge (as viewed in FIG. 2) of each document 14 placed on feed magazine 12. The feed augers 20*a,b*, 24, and 26*a,b* are rotatably driven through drive means (not shown) so as to progressively feed the documents 14 toward the feeder assembly 10 while the documents are disposed in upstanding on-edge relation on the feed magazine 12 transverse to the longitudinal axes of the feed augers, as is known. It will be appreciated by those skilled in the art that the augers 20*a,b*, 24, 26*a,b* may be replaced where desired by other document conveying apparatus, such as, but not restricted to endless belt systems.

The feeder assembly 10 in the illustrated embodiment includes three endless feeder belts 30*a*, *b* and *c* carried on a frame 32, which in the preferred embodiment is pivotable, but is also contemplated as conceivably being nonpivotable. The pivot frame 32 includes a pair of parallel, vertically spaced pivot arms 32*a* and 32*b* which are pivotally supported on a vertical drive shaft 34 which in turn is rotatably supported by a bracket (not shown) fixed to the support plate 16. The drive shaft 34 supports three identical drive rollers 36*a*, 36*b* and 36*c* (36*b* and 36*c* not visible in FIG. 1) and extends below the support plate 16 for connection to rotary drive means (not shown) through a conventional clutch/-brake operative to effect selective rotation and braking of the drive shaft 34 and drive rollers 36*a–c*.

The ends of the pivot arms 32*a,b* opposite the drive shaft 34 support a shaft 38 in parallel relation to drive shaft 34. The shaft 38 has three idler rollers 40*a,b* and *c* rotatably supported thereon such that each idler roller lies in coplanar relation with a corresponding one of the drive rollers 36*a–c*. The feeder belts 30*a,b* and *c* are trained about and supported on corresponding pairs of rollers, 36*a*, 40*a*, 36*b*, 40*b* and 36*c*, 40*c*, respectively.

Drive rollers 36*a–c* and idler rollers 40*a–c* are of equal diameter and are preferably crowned to maintain positive belt tracking. The runs of the feeder belts 30*a–c* extending between the drive rollers 36*a–c* and idler rollers 40*a–c* are coplanar and normally lie generally transverse to the feed path of the feed magazine 12. The coplanar runs of the feeder belts 30*a–c* between the pairs of rollers 36*a–c* and 40*a–c* are adapted to be engaged by the forward surface of each successive leading document, such as indicated at 14*a* in FIG. 2, fed to the feeder assembly 10 by the feed magazine 12.

In the illustrated embodiment, the feeder belts 30*a–c* have equal size openings 41 spaced generally equidistantly along their lengths such that during driving movement of the feeder belts, the openings pass a vacuum manifold 42 having a forward surface over which the inner surfaces of the feeder belts slide. The vacuum manifold 42 has suitable openings adapted to register with the openings in the feeder belts. The vacuum manifold 42 is connected to a vacuum source (not shown) so as to draw the leading document on the feed magazine against the high friction outer surfaces of the feeder belts by suction and effect positive feeding of successive documents in a direction transverse to the feed direction of the feed magazine, as is known.

The pivot frame 32 is biased to a position wherein the coplanar document engaging runs of the feeder belts 30*a–c* are disposed substantially transverse to the document feed path of the feed magazine 12 by a biasing device in the form of a coil tension spring 44 which is mounted to a stop adjust assembly 46. The assembly 46 includes an elongate rod 48 having a first end 50 configured to engage the lower frame arm 32*b* as the frame 32 is moved backward under the pressure of documents 14 being fed by the magazine 12. In FIG. 1, the end 50 is shown pinned to the frame 32, however other types of engagement are contemplated.

The rod 48 is slidably engaged in an support block 52 which is secured to the support plate 16. A spring attachment point, opening or lug 54 is located on the support block 52 to receive one end of the spring 44. The opposite end of the spring 44 is attached to a similar attachment point 56 located on the second end 58 of the rod 48.

A feeder back stop adjustment collar 60 is mounted to the rod 48 between the first end 50 and the support block 52 to define the rearward pivot travel of the frame 32 away from the magazine 12. Similarly, a feeder front stop adjust collar 62 is mounted to the rod 48 between the support block 52 and the second end 58 to define the forward limit of travel of the frame 32 toward the magazine 12. If desired, the rod 48 may have portions helically threaded, and the collars 60, 62 may be nuts threadably engaged on the rod.

The stop adjustment assembly 48 thus operates to exert a biasing force on the frame 32 to maintain a "zero" position (best seen in FIG. 2), which disposes the runs of the belts 30*a–c* relatively transverse to the path of documents 14 carried by the magazine 12. As the pressure exerted by the documents 14 against the belts 30*a–c* increases, eventually the force exerted by the spring 44 will be overcome, causing the frame 32 to pivot backward about shaft 34, depending on the amount of pressure exerted, even to the point at which the frame 32 contacts the back stop adjustment collar 60.

Referring to FIGS. 1–4, an important feature of the present invention is that the presence or absence of, and the amount of pressure exerted by, stacked documents 14 against the pivot frame 32 may be used to control the speed of the motors which drive the feed magazine augers 20*a*, 20*b*, 24, 26*a* and 26*b*. As the pressure exerted by the documents 14 abates, as through the feeding of documents through the feeder 10, or the creation of gaps of documents along the feed magazine 12, the speed at which the documents 14 are advanced by the magazine 12 will be increased to maximize the efficiency of the feeder assembly 10. Conversely, if the stacked documents 14 exert significant pressure against the frame 32, such as when the magazine 12 is filled with closely bunched or many thick documents, the magazine will be signalled to slow or even interrupt the advancement of documents.

The preferred structure employed to sense the pressure of the stacked documents against the frame 32 and to signal the magazine drive system accordingly is a document sensing and control mechanism, indicated generally at 64. The document sensing and control mechanism 64 includes a document sensing lever 66 having a sensing end 68, a central portion 70, and an actuator end 72. Prior to the placement of documents 14 on the magazine 12, the sensing lever 66 assumes an at-rest position in which the sensing end 68 projects outwardly past the plane defined by the runs of the belts 30*a–c* (best seen in FIG. 2). It is preferred that the sensing lever 66 passes between the middle and lowest feeder drive belts 30*b* and *c* in order to contact documents 14 having the widest range of heights.

Due to the construction of the feeder assembly 10, it is also preferred that the document sensing lever be provided with a generally U-shaped portion 74 located between the sensing end 68 and the central portion 70. The portion 74 allows the sensing lever 66 to pivot freely without being obstructed by the position of the idler shaft 38.

A pivot shaft 76 fixed to the support plate 16 provides the axis of pivotal rotation of the sensing lever 66, and also serves as the attachment point of the lever to the support plate. The pivot shaft 76 matingly engages a throughbore 78 located in the center portion 70 of the lever 66. The center portion 70 is preferably split and provided with a set screw 80*a* which clamps the sensing lever 66 upon a bearing sleeve 81 the pivot shaft 76 so that the lever freely pivots about the pivot shaft 76. Screws 80*b* and 80*c* (best seen in FIGS. 3 and 4) secure the document sensing end 68 to the central portion 70 of the document sensing lever 66.

A coiled spring 82 is attached to the sensing lever 66 between the central portion 70 and the actuator end 72 to provide a biasing force which biases the sensing end 68 past the plane of the belts 30*a–c* and towards the documents 14. The spring 82 is attached to the lever 66 at a point 84, which may be an opening or a lug, and at its opposite end, to a point 86 on the support plate 16, which also may be an opening or a lug.

At the actuator end 72 of the document sensing lever 66, a potentiometer 88 is pivotally secured at point 90. The potentiometer 88 is also secured to the support plate 16 at point 92. The potentiometer 88 is preferably of the linear contactless magneto-resistive type, with a preferred model sold as MIDORI LP 20 UF-R, distributed by MIDORI AMERICA CORP., Calif. The potentiometer 88 translates the physical pivotal movement of the sensing lever 66 into an electrical signal which is transmitted to the magazine drive 159 (best seen in FIG. 6), and which electrical signal varies with the position of sensing lever 66.

If desired, the tip of the actuator end 72 of the document sensing lever 66 may be provided with a laterally threaded opening 94 through which a stop adjustment screw 96 is threadably engaged. The tip of the screw 96 is positioned to engage a contact arm 98 of a stop switch 100 which is secured to the support plate 16 and which is electrically connected to the magazine drive 159 (FIG. 6) to interrupt the advancement of documents upon the magazine 12 when the pressure exerted against the feeder assembly 10 causes maximum pivotal displacement of the sensing lever 66. This insures constant pressure against the document stack, and prevents the jamming of documents. Preferably, the potentiometer 88 will be equipped with an internal interrupt feature, which will obviate the need for the switch 100.

Referring to FIG. 2, the document feeder assembly 10 is also provided with a feeder belt take-up assembly 104 including an adjustable pivoting frame 106. The frame 106 is provided with three rollers 108 which are vertically spaced to each engage a corresponding one of the belts 30*a–c*. In this manner, a predetermined tension is maintained on the belts 30*a–c*, and may be adjusted to accommodate belt stretching through wear, as is known in the art.

In addition, the document feeder assembly 10 includes a document stripper mechanism, indicated generally at 110, which includes a plurality of vertically spaced stripper shoes 112. The stripper shoes 112 are biased against the run of the belts 30*a–c* and are designed to prevent the passage of more than one document 14 through the feeder assembly 10 at a time.

The document feeder assembly 10 is also provided with an accelerator station, generally indicated at 114, which is designed to speed the advancement of the documents 14 from the feeder assembly 10 to downstream processing and handling stations. The accelerator assembly 114 includes first and second groups of vertically spaced accelerator rollers 116, 118, respectively, each having a corresponding set of opposing backup rollers 120, 122, respectively. The positioning of the accelerator rollers 116, 118 on opposite sides of the document path minimizes the mutilation of documents being advanced downstream, since both sides of the documents are engaged by accelerator rollers.

Figure 3:
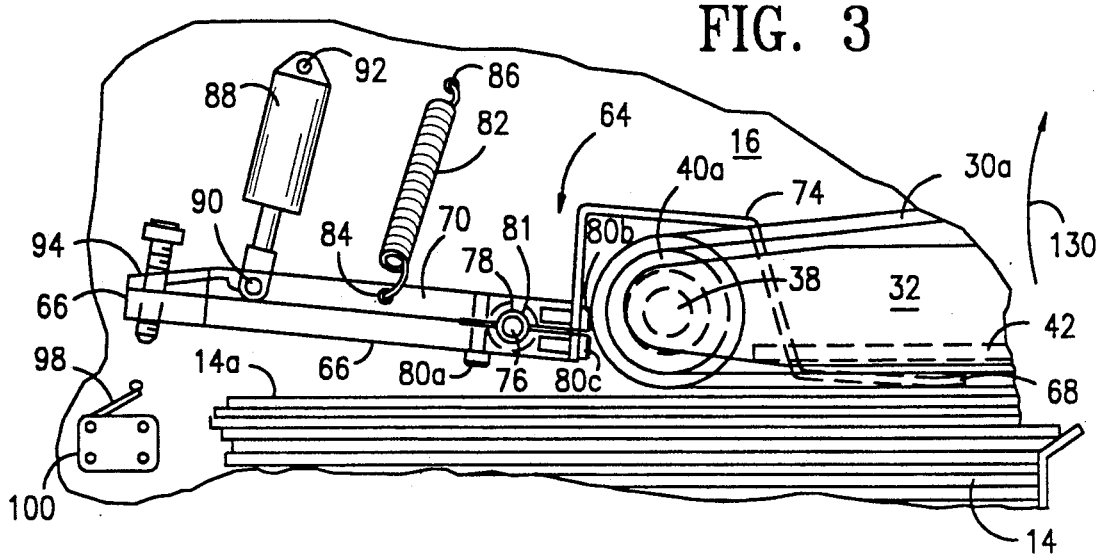
FIG. 3 is a fragmentary plan view of the feeder assembly of FIG. 1 illustrating the document sensor lever flush with the plane of the feeder belts.
Figure 4:
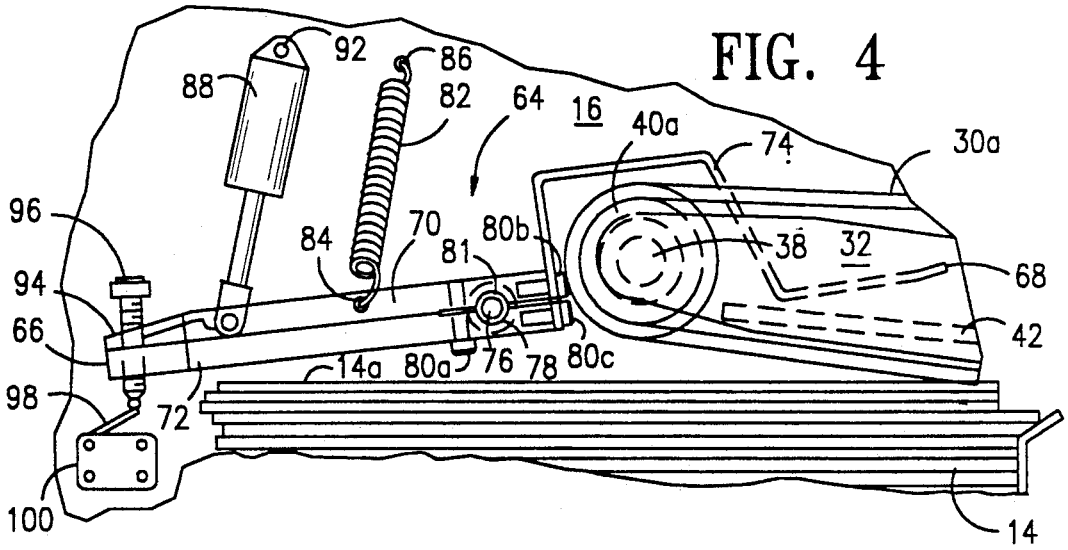
FIG. 4 is a fragmentary plan view of the feeder assembly of FIG. 1 illustrating the document sensor lever in the conveyor shut off position.

Referring to FIGS. 2–4, three operational positions of the document sensing lever 66 are indicated. In FIG. 2, there are no documents 14 pressing against the lever 66, and, as such, the spring 82 biases the sensing end 68 to the limit of extension beyond the plane of the belts 30*a–c*. In this position, the orientation of the potentiometer 88 is such that the magazine drive 159 is signalled to operate at top speed to advance documents 14 to the feeder assembly 10 as rapidly as possible, where the documents 14 are removed one by one from the stack by belts 30*a–c*.

In FIG. 3, the number of documents 14 stacked against the lever 66 and the pivot frame 32 has increased, as is indicated by the flush position of the document sensing end 68 relative to the plane of the belts 30*a–c*. In this position, the orientation of the potentiometer 88 is such that the magazine drive 159 is signalled to operate at a slower speed than depicted in FIG. 2, but still fast enough to ensure a satisfactory supply of documents to maintain the document removal function of the feeder assembly 10 at an efficient operational level. At about the position shown in FIG. 3, additional pressure exerted by the stacked documents 14 will cause the pivot frame 32 to pivot backwards slightly in the direction indicated by the arrow 130, and lever 66 also moves rearwardly as pivot frame 32 moves.

In FIG. 4, the pressure exerted by the documents 14 advanced by the feed magazine 12 has increased to the extent that the document sensing lever 66 and pivot frame 32 have reached the limit of their respective rearward pivot travel, and the potentiometer 88 is oriented to signal the magazine drive 159 to substantially slow, or even halt the advancement of documents. Thus, the greater the pivotal displacement of the document sensing lever 66, the slower the speed at which documents 14 are advanced by the feed magazine 12 toward the moving belts 30*a–c*.

This so-called low speed limit point of the travel of the document sensing lever 66, as shown in FIG. 4, is a specified rearward distance from the plane of the belts 30*a–c* at the "zero" position indicated in FIG. 2. The reason for the spaced location of the limit point is that it is important that the lead document 14*a* be uniformly flat against the plane of all belts 30*a–c*. Although the vacuum manifold 42 plays a role in drawing the document 14*a* against the belts, the pressure exerted by the advancing documents also presses the lead document against the belts and pivots the frame 32 in the direction of arrow 130. By ensuring that the magazine drive 159 will continue to advance documents 14 toward the feeder assembly 10 even after the lead document 14*a* has initially contacted the belts 30*a–c*, and has even caused an amount of rearward pivoting movement of the frame 32, a more definite engagement of the document by the feeder assembly 10 is provided for. Thus, there is an inherent hysteresis built into the operation of the document sensing and control apparatus 64.

It will be appreciated that while three distinct positions of the document sensing lever 66 are illustrated in FIGS. 2–4, that there are an infinite number of positions of the lever 66, and a corresponding number of speeds at which the magazine drive 159 is operated, between the limits of FIGS. 2 and 4. Likewise, the potentiometer 88 is continually variable along the entire range of movement of the sensing lever 66, and emits a corresponding continually variable signal to the magazine drive 159.

Figure 5:
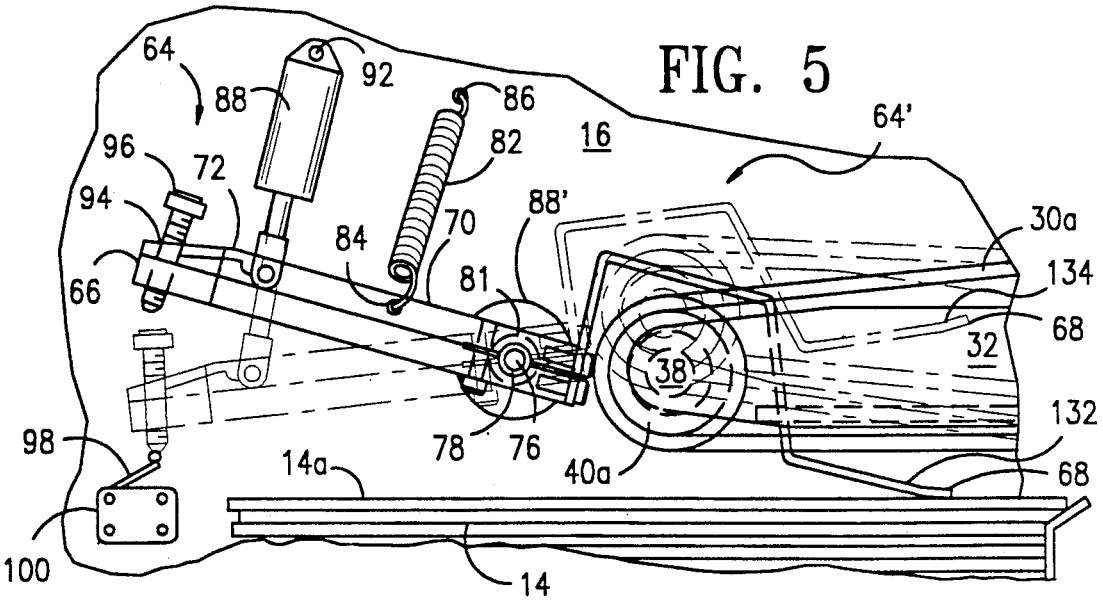
FIG. 5 is a fragmentary plan view of an alternate embodiment of the document sensor lever of FIG. 1.

Referring to FIG. 5, an alternate embodiment of the document sensing and control apparatus 64 is indicated generally at 64'. The apparatus 64' is identical to the apparatus 64 in all respects, and has been provided with identical reference numerals, with the exception of the potentiometer 88. In the apparatus 64', the linear potentiometer 88 has been replaced with a rotary potentiometer 88', which translates pivotal movement of bearing sleeve 81, to which sensing lever 66 is attached, into electrical signals. A preferred type of rotary potentiometer 88' is sold by MIDORI AMERICA CORP., Calif. In FIG. 5, the limits of travel of the document sensing lever 66 are indicated as a first position 132 where a lack of documents 14 causes the potentiometer 88' to signal the magazine drive to operate at high speed, and a second position 134 where the maximum pressure is exerted by the documents against sensing lever 66 and pivot frame 32 (shown in phantom), and causes the potentiometer 88' to signal an interruption in the advancement of documents towards the belts 30*a–c*.

Figure 6:
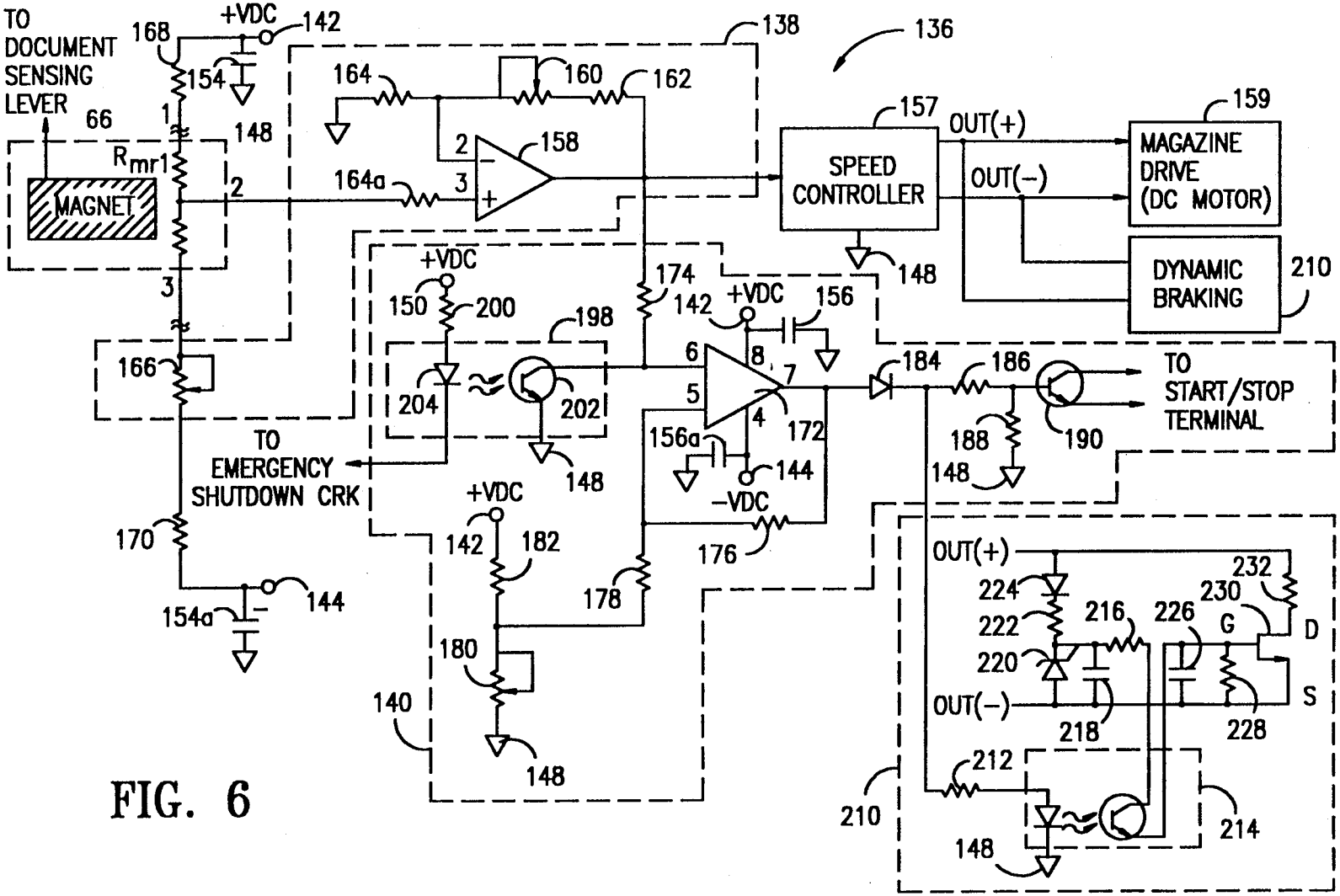
FIG. 6 is a schematic of the electrical circuit for operation of the document conveyor and document sensor lever of the invention.

Referring to FIG. 6, a variable speed controller circuitry is generally indicated at 136 for varying the speed of magazine drive 159, which in turn controls the speed of the augers 20*a,b*, 24 and 26*a,b* of feed magazine 12 (a DC motor—not shown—drives the augers). The circuit includes the potentiometer 88, an adjustable controlling voltage stage 138, an adjustable motor stopping stage 140, and a dynamic braking stage 210. Power sources include a +VDC source 142 and a −VDC source 144, such as a +12 VDC and a −12 VDC source, and a common ground 148. These power sources are supplied by a speed controller 157, such as a model C.MH.23.787A.CM speed controller manufactured by ELECTRO COMPANY, Pennsylvania, but may also be supplied by any suitable power source. The variable speed controller circuitry 136 also uses an isolated +VDC supply 150. The +VDC power source 142 includes filter capacitors 154 and 156. The −VDC power supply 144 also has similar filter capacitors 154*a* and 156*a*.

The document sensor lever arm potentiometer 88 may be modeled as a voltage divider circuit having a first magneto-resistance element $R_{mr1}$ and a second magneto-resistance element $R_{mr2}$ wherein the second element $R_{mr2}$ is in series with the first magneto-resistance element $R_{mr1}$. A permanent magnet moves along the resistive elements thereby varying the flux and changing their resistance; such devices are known in the art. The potentiometer 88 has a first terminal, a second terminal, and a third terminal with the magneto-resistance elements $R_{mr1}$ and $R_{mr2}$ connected between the first terminal and the third terminal while the second terminal connects to both magneto-resistive elements at their shared series connection.

The adjustable controlling voltage stage 138 for controlling voltage to a DC motor speed controller 157 includes an amplifier 158, such as one from a dual op amp, e.g., MC1458, a variable resistor 160, a resistor 162, a resistor 164, a resistor 164*a*, and a variable resistor pot 166. The variable resistor pot 166 facilitates adjusting the minimum speed of the magazine drive 159 while resistor pot 160 facilitates adjusting the maximum speed of the magazine drive 159. The amplifiers 158 and 172 are biased by the +VDC supply 142 and by the −VDC supply 144.

One terminal of a current limiting resistor 168 connects to the +VDC supply 142 while the opposite terminal of the resistor connects to the first terminal of the potentiometer 88. The second terminal of the potentiometer 88 connects to one end of resistor 164*a*. The third terminal of the potentiometer 88 connects to one terminal of variable resistor 166. The opposite terminal of variable resistor 166 connects to a current limiting resistor 170. The other terminal of current limiting resistor 170 connects to the −VDC supply 144.

The opposite terminal of the resistor 164*a* connects to a positive input of the amplifier 158. A negative input of the amplifier 158 connects to a terminal of another resistor 164, and also connects to one terminal of variable resistor 160. The opposite terminal of resistor 164 connects to common ground. The other terminal of variable resistor 160 connects to resistor 162. The opposite terminal of resistor 162 connects to the output pin (pin 1) $V_{out1}$ of the amplifier 158. The output pin of the amplifier $V_{out1}$ couples to the speed controller 157. $V_{out1}$ serves as a controlling voltage for directing the speed controller 157, which controls the magazine drive 159 to vary the rate at which the magazine 12 feeds documents.

The adjustable motor stopping stage 140 with hysteresis for stopping the augers 20*a,b*, 24 and 26*a,b*, includes a comparator 172 configured from a second op-amp from the MC1458, a current limiting resistor 174, a hysteresis resistor 176, a second hysteresis resistor 178, a variable resistor 180, a resistor 182, a diode 184 such as an 1N4148, a current limiting resistor 186, a pull-down resistor 188, an npn transistor 190, an opto-isolator 198 such as a 4N35, and a current limiting resistor 200.

One end of current limiting resistor 174 connects to the output $V_{out1}$ of amplifier 158. The other end of current limiting resistor 174 connects to a negative input of the comparator 172. A positive input of the comparator 172 connects to one end of the second hysteresis resistor 176 and to one end of hysteresis resistor 178. The other end of hysteresis resistor 176 connects to the output pin ($V_{out2}$) of comparator 172. The output pin of comparator 172 also connects to the anode of diode 184. The other end of the second hysteresis resistor 178 connects to the resistor 182 and also connects to one terminal of the variable resistor pot 180. The other end of resistor 182 connects to the +VDC source 142. The opposite terminal of variable resistor 180 connects to common ground.

The cathode of diode 184 connects to one terminal of the resistor 186. The opposite terminal of resistor 186 connects both to the base of transistor 190 and to one terminal of pull-down resistor 188. The opposite end terminal of pull-down resistor 188 couples to common ground. The collector and emitter of transistor 190 connect to start/stop terminals of speed controller 157.

Opto-isolator 198 contains an npn transistor 202, and a light emitting diode (LED) 204. The emitter within the opto-isolator circuit 198 is connected to common ground. The collector of phototransistor 202 connects to both resistor 174 and the negative input of comparator 172. The base of phototransistor 202 receives light from LED 204 which serves to energize the phototransistor 202. The cathode of LED 204 connects to a multifunction interconnect board (not shown) that facilitates emergency stopping of the magazine augurs by energizing the LED 204 thereby supplying base drive for the phototransistor 202. The anode of LED 204 connects to one end of current limiting resistor 200. The other end of current limiting resistor 200 connects to the isolated +VDC supply 150.

The dynamic braking circuit 210 includes a current limiting resistor 212, an opto-isolator 214 similar to opto-isolator 198, a resistor 216, a capacitor 218, a zener diode 220, a resistor 222, a diode 224, a capacitor 226, a resistor 228, a field effect transistor (FET) 230, and a current limiting resistor 232.

One end of the current limiting resistor 212 connects to the cathode of diode 184 while the other end connects to the anode of the LED in the opto-isolator 214. The collector of the phototransistor in the opto-isolator 214 connects to one end of resistor 216. The other end of resistor 216 connects to one terminal of capacitor 218 and to the cathode of zener diode 220. The opposite end of capacitor 218 and the anode of the zener diode 220 connect to a negative power terminal associated with the DC motor (OUT(−)). The cathode of zener diode 220 also connects to one terminal of resistor 222. The opposite terminal of resistor 222 connects to the cathode of diode 224. The anode of diode 224 connects to the positive power terminal associated with the DC motor (OUT(+)).

The emitter of the phototransistor in the opto-isolator 214 connects to one terminal of capacitor 226, one terminal of resistor 228, and the gate of FET 230. The opposite ends of capacitor 226 and resistor 228, in addition to the source of FET 230, connect to OUT(−). The drain of FET 230 connects to one end of current limiting resistor 232. The other end of current limiting resistor 232 connects to OUT(+).

In operation, the potentiometer 88 associated with the document sensing lever 66 serves as a part of positional feedback system. As the document sensing lever 66 pivots, its linkage to the potentiometer 88 causes the potentiometer resistance to vary in proportion to the pivotal rotation of the sensing lever. To illustrate, the +VDC supply 142 and the −VDC supply 144 bias the potentiometer 88, causing voltage division to occur among the string of resistors connected in series, namely resistor 168, the magneto-resistive elements $R_{mr1}$ and $R_{mr2}$ in the linear potentiometer 88, the variable resistor 166 and resistor 170. The voltage between the magneto-resistive elements at the second terminal provides the input voltage to the adjustable controlling voltage stage 138.

The movement of document sensing lever 66 applies a force to the potentiometer 88, thereby moving the internal permanent magnet relative to the magneto-resistive elements $R_{mr1}$ and $R_{mr2}$. This varies the resistance in the resistive elements $R_{mr1}$ and $R_{mr2}$, causing the voltage at the voltage division output terminal 2 to change.

Generally, the amplifier 158 has a variable gain dictated by the value of the resistor 162, the variable resistor 160, and the resistor 164. As known in the art, the range of gain varies from $$\left(1 + \frac{R162}{R164} \text{ to: } 1 + \frac{R160 + R162}{R164}\right)$$

depending on the value of variable resistor 160. The output voltage $V_{out1}$ from the adjustable controlling voltage stage 138 couples to the DC motor speed controller 157 and to the adjustable stopping circuit 140. The DC motor speed controller 157 then varies the speed of the augers 20*a,b*, 24, and 26*a,b* for the magazine 12 in response to this voltage level. The gain is necessary to provide the speed controller 157 with a suitable voltage level.

The minimum and maximum speed at which the magazine drive 159 will propel the augers 20*a,b*, 24 and 26*a,b* depends on the adjusted values of the variable resistors 160 and 166. The variable resistor 160 in the feedback path about the amplifier 158 facilitates maximum speed calibration. This occurs by first placing the document sensing lever 66 in the maximum speed position (best seen in FIG. 4) then adjusting the variable resistor pot 160 to achieve the desired maximum speed. The variable resistor 166 facilitates minimum speed calibration. This occurs by placing the sensing lever 66 in the minimum speed position (best seen in FIG. 2), then adjusting the variable resistor 166 to achieve the desired minimum speed.

The adjustable stopping circuitry 140 uses hysteresis to avoid unintentional shut down of the magazine drive 159. The point at which the position of the sensing lever 66 justifies stopping the augers may be adjusted using variable resistor 180. Adjusting the desired stop position of the document sensing lever 66 occurs by setting the variable resistor pot 180 to zero ohms, then positioning the document sensing lever in the desired stop position. Once the document sensing lever 66 reaches the stop position, the resistance produced by variable resistor 180 is adjusted to produce a desired stop reference voltage across the variable resistor 180.

When the document sensing lever 66 is in the stop position, the voltage level at the negative input to comparator 172 is lower than when the document sensing lever is in a non-stop position. Consequently, the stopping circuitry will keep transistor 190 turned off during non-stop conditions. Conversely, when the stop position is reached, the output from comparator 172 will cause the transistor 190 to be turned on, thereby halting movement of the augers 20*a, b*, 24 and 26*a, b*.

The dynamic braking circuit 210 serves to immediately stop the DC motor in the magazine drive 159 when the document sensing lever 66 is at the stop position to eliminate the coasting of the DC motor. To illustrate, when the sensing lever 66 is in the stop position, the output of comparator 172 in the adjustable motor stopping stage 140 goes high (toward the positive rail of +VDC 142) thereby turning on transistor 190 which in turn disconnects the power supply (OUT+) and (OUT−) to the DC motor.

The output of comparator 172 also activates the optoisolator 214 which causes the charging of capacitor 226 through resistor 216 (RC constant) causing a delay before the FET is activated. Once the FET turns on, remaining current is directed through resistor 232 (3 ohms) thereby bleeding off the remaining energy generated by the DC motor. This draining creates magnetic flux at the motor's rotor causing the motor to brake. Although an N channel FET is used in the preferred embodiment, other suitable devices may be substituted such as a silicon controlled rectifier (SCR). As is obvious to one of ordinary skill in the art, the dynamic braking circuitry 210 may not be necessary with a speed controller that contains internal braking circuitry.

Thus, it will be appreciated that the present automatic magazine speed control is designed to maintain an efficient and constant flow of documents to the feeder assembly 10 through variable control over the speed of advancement of documents along the feed magazine 12. Through the use of the document sensing lever 66, when fewer documents are pressing against the belts 30*a–c*, the magazine will speed the advancement of documents toward the feeder assembly. Conversely, when a sufficient amount of documents are pressing against the belts 30*a–c*, the magazine 12 will be signalled to slow or even halt the advancement of documents.

While a preferred embodiment of the automatic magazine speed control in accordance with the present invention has been illustrated and described, it will be understood that changes and modifications may be made therein without departing from the invention in its broader aspects. Various features of the invention are defined in the following claims.

What is claimed is:

1. A document processing system, comprising:

a feed magazine for supporting a stack of flat documents in generally upstanding on-edge relation and advancing the documents along a feed path with the documents disposed generally transverse to the feed path;

a feeder assembly including document engaging means for engaging the leading document in the stack and feeding the leading document in a direction generally transverse to the feed path;

document sensing and control means comprising a document sensing lever disposed in operational relationship to said feeder assembly for sensing the presence or absence of at least one document advanced by said feed magazine for engagement by said feeder assembly, and further comprising a variable speed controller circuitry means for adjustably controlling the speed of the advance of documents on the feed magazine as a function of the pressure exerted by the documents on said document sensing lever and for providing adjustable minimum and maximum speeds at which the documents are advanced by said feed magazine.

2. The document processing system as defined in claim 1 wherein said document sensing and control means is configured to speed the advancement of documents by said feed magazine upon the sensing of reduced pressure by said documents against said document sensing and control means.

3. The document processing system as defined in claim 1 further including means for driving said document feed magazine, and wherein said document sensing lever is electrically connected to said drive means for controlling the speed of documents advanced along said magazine in relation to the pivotal displacement of said lever.

4. The document processing system as defined in claim 3 wherein said lever is connected to said drive means so that the greater the pivotal displacement of said lever, the slower the advancement of documents along said magazine by said drive means.

5. The document processing system as defined in claim 4 wherein said document engaging means includes at least one belt run which defines a plane of contact for receiving documents advanced by said feed magazine, and upon the displacement of said lever a specified distance past said plane of said feed belt, said lever signals said feed magazine to interrupt the advancement of documents along said feed path.

6. The document processing system as defined in claim 3 further including a potentiometer connected to said lever and to said drive means for translating the pivotal displacement of said lever into electrical signals transmitted to said drive means as a function of said pivotal displacement of said lever.

7. The document processing system as defined in claim 6 wherein said potentiometer is a linear potentiometer.

8. The document processing system as defined in claim 6 wherein said potentiometer is a rotary potentiometer.

9. The document processing system as defined in claim 4 further including switch means for deenergizing said feed magazine and interrupting the advancement of documents along said feed magazine upon a specified amount of displacement of said lever.

10. The document processing system as defined in claim 1 wherein said document engaging means of said feeder assembly includes at least one pivot frame supporting feeder belt means having at least one belt run to enable pivotal movement of the belt run against a biasing force in response to a predetermined pressure applied to the belt run by the stack of documents, wherein said at least one pivot frame supports a plurality of vertically spaced rotatable drive rollers and a corresponding number of idler rollers, said feeder belt means includes a plurality of feeder belts supported by said drive rollers and idler rollers in vertically spaced relationship to establish horizontal coplanar belt runs defining said at least one belt run, and said document sensing and control means comprises a sensing lever disposed to project between adjacent belts for engaging documents advanced by said feed magazine.

11. The document processing system as defined in claim 10 further including means for biasing said at least one pivot frame to a position wherein said belt run is generally transverse to the feed path of the feed magazine.

12. A document processing system, comprising:

a feed magazine for supporting a stack of documents in generally upstanding on-edge relation and advancing the documents along a feed path with the documents disposed generally transverse to the feed path;

feed magazine drive means for driving said feed magazine;

a feeder assembly including a pivotal feeder belt frame and feeder belt means disposed on said frame to define a belt run for engaging the leading document in the stack and feeding the leading document in a direction generally transverse to the feed path; and document sensing and control means comprising a document sensing lever disposed in operational relationship to said feeder assembly, and being pivotally displaced by documents advanced by said feed magazine, for sensing the pressure exerted by documents against said document sensing lever and further comprising a variable speed controller circuitry means being electrically connected to said feed magazine drive means for adjustably controlling the speed of the advance of documents on the feed magazine as a function of said pressure and for providing adjustable minimum and maximum speeds at which said feed magazine is driven.

13. The document processing system as defined in claim 11 wherein said document sensing and control means is configured to speed the advancement of documents by said feed magazine upon the sensing of reduced pressure against said document sensing and control means, and to slow the advancement of documents by said feed magazine upon the sensing of increased pressure against said document sensing and control means.

14. The document processing system as defined in claim 12 wherein said document sensing lever is electrically connected to said feed magazine drive means for controlling the speed of documents advanced along said magazine in relation to the pivotal displacement of said lever.

15. The document processing system as defined in claim 14 further including a potentiometer connected to said lever and to said drive means for translating the pivotal displacement of said lever into electrical signals transmitted to said drive means.

16. The document processing system as defined in claim 15 wherein said potentiometer is a linear potentiometer.

17. The document processing system as defined in claim 15 wherein said potential meter is a rotary potentiometer.

18. The document processing system as defined in claim 13 further including switch means for deenergizing said feed magazine and interrupting the advancement of documents along said feed magazine upon a specified amount of displacement of said lever.

* * * * *